US010053907B2

(12) United States Patent
Russo, Jr.

(10) Patent No.: US 10,053,907 B2
(45) Date of Patent: Aug. 21, 2018

(54) EASY A-C SCREEN

(71) Applicant: Antonio A Russo, Jr., Westbrook, ME (US)

(72) Inventor: Antonio A Russo, Jr., Westbrook, ME (US)

( * ) Notice: Subject to any disclaimer, the term of this patent is extended or adjusted under 35 U.S.C. 154(b) by 0 days.

(21) Appl. No.: 15/455,424

(22) Filed: Mar. 10, 2017

(65) Prior Publication Data

US 2018/0051510 A1 Feb. 22, 2018

Related U.S. Application Data

(60) Provisional application No. 62/377,141, filed on Aug. 19, 2016.

(51) Int. Cl.
*E06B 7/28* (2006.01)
*E06B 9/52* (2006.01)

(52) U.S. Cl.
CPC ..... *E06B 7/28* (2013.01); *E06B 9/522* (2013.01)

(58) Field of Classification Search
CPC ..... E06B 7/28; E06B 9/522
USPC ..... 160/372
See application file for complete search history.

(56) References Cited

U.S. PATENT DOCUMENTS

| | | | | |
|---|---|---|---|---|
| 2,113,310 | A * | 4/1938 | Peters | E06B 9/522 160/226 |
| 2,925,026 | A | 2/1960 | Schuster et al. | |
| 3,431,966 | A * | 3/1969 | Injeski | E06B 9/02 160/225 |
| 3,460,458 | A | 8/1969 | MacLeod | |
| 3,476,034 | A | 11/1969 | Ulich | |
| 3,844,204 | A | 10/1974 | Ball | |
| 3,861,283 | A | 1/1975 | Shaner | |
| 4,688,619 | A * | 8/1987 | Kessler | E06B 9/52 160/225 |
| 4,884,614 | A * | 12/1989 | Spurling | E06B 9/02 160/216 |
| 5,035,116 | A | 7/1991 | Main | |
| 5,295,903 | A | 3/1994 | Bolton et al. | |
| D417,288 | S | 11/1999 | Bissell | |
| 5,979,533 | A | 11/1999 | Dupuie | |
| 6,711,857 | B1 * | 3/2004 | Wagnitz | E05B 47/0002 49/394 |
| 7,029,055 | B2 | 4/2006 | Bourque et al. | |
| 8,082,969 | B2 | 12/2011 | Okachi | |
| 2008/0127556 | A1 * | 6/2008 | Trujillo | E06B 3/46 49/28 |

* cited by examiner

*Primary Examiner* — Katherine W Mitchell
*Assistant Examiner* — Johnnie A. Shablack
(74) *Attorney, Agent, or Firm* — Wayne A. Keown; Verrill Dana LLP

(57) ABSTRACT

The invention provides an attractive, easy to install, window screen that can fit the open window space adjacent to a window-mounted air conditioner for any nominally-sized window.

3 Claims, 4 Drawing Sheets

EASY A-C SCREEN

BACKGROUND OF THE INVENTION

Window-mounted air conditioners provide a convenient means for cooling room temperatures below ambient temperature. A problem with such window-mounted air conditioners is that window sizes are not standard, so it is necessary to block any portion of the window that is not filled with the air conditioner to both prevent colder room air from escaping outside the room and to prevent dust, insects, rain and other outdoor particles from entering the room.

Typically, this problem is addressed by fitting the window-mounted air conditioner with accordion-like side panels, which can expand to fill the open spaces. These accordion-like side panels, however, have several disadvantages. To maintain proper spacing, they must be held in place by connectors to the window frame, such as screws or tape, which can damage or mar the window frame. In some cases, they may not be appropriately sized to fill the space completely. They are also physically unsightly and difficult to store in the off-season without damaging them.

There is, therefore, a need to provide new means for filling open window space adjacent to a window-mounted air conditioner that overcomes these disadvantages.

BRIEF SUMMARY OF THE INVENTION

The invention provides a more attractive, easier to install, window screen that can fit the open window space adjacent to a window-mounted air conditioner for any nominally-sized window. The screen according to the invention requires no connectors to hold it in place, and can easily be stored in the off-season, without concern of it being damaged. The window screen according to the invention comprises two plates of a solid material that are slidably arranged to each other to allow expansion to fill the open window space.

DESCRIPTION OF THE PREFERRED EMBODIMENTS

Figure 1:
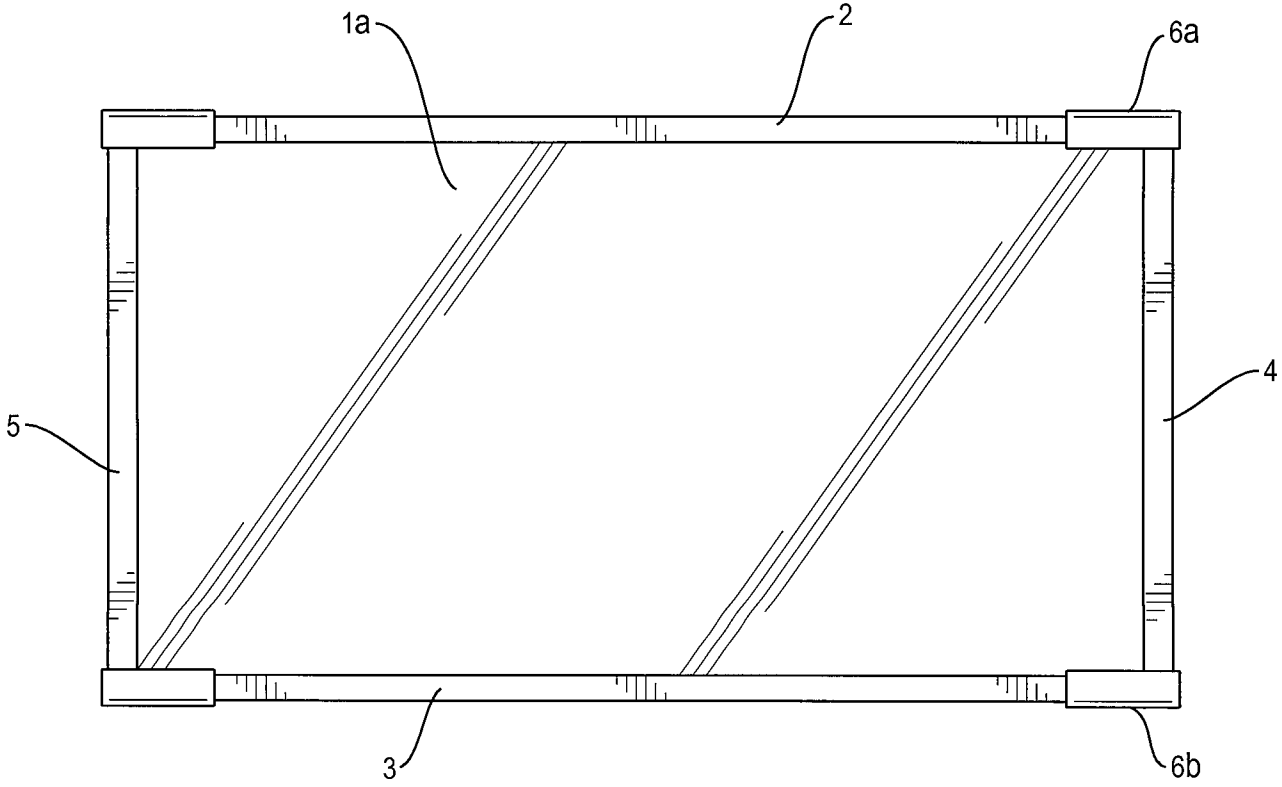
FIG. 1 shows a single frame of the two-plate window screen.

With reference to the drawings, FIG. 1 shows a front view of one screen unit of the unexpanded two-unit window screen. In this view, the second screen unit is hidden by the first screen unit. The first screen unit has a rectangular frame defining an opening in which is mounted a plate of a solid material 1. The first frame has a top frame member 2, a bottom frame member 3 opposite the top frame member, a first side frame member 4 and a second side frame member 5 each of which connect to opposite ends of both the top frame member and the bottom frame member.

Figure 2:
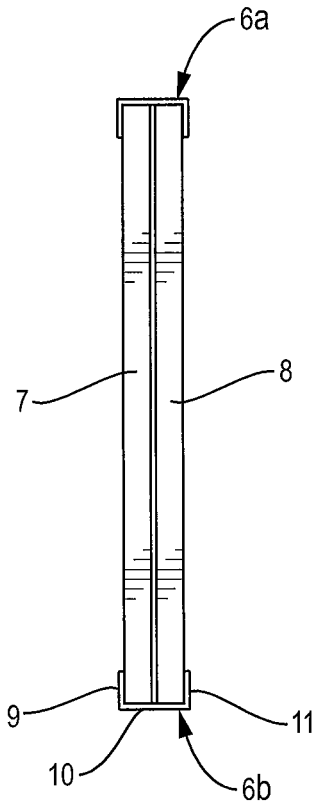
FIG. 2 shows a side view of the two-plate window screen.

FIG. 2 shows a side view of the two-plate window screen. In this view can be seen a first pair of brackets 6*a*, 6*b* affixed to the first screen unit, one bracket being fixed to the top frame member 5 proximate where the first side member interconnects to the top frame member and the other bracket being fixed to the bottom frame member proximate where the first side member interconnects to the bottom frame member. Each bracket of the first pair of brackets is U-shaped with a first leg 9 affixed to a front surface of the rectangular frame of the first screen unit, a base 10 extending across a width of the rectangular frame and beyond the width of the rectangular frame, a distance substantially equal to the width of the frame and the second leg 11 defining a cavity 12 (see FIG. 3) between the second leg (which is affixed to the second screen unit) and the back surface of the rectangular frame. Similarly, a second pair of brackets (not visible in this view) has a first leg affixed to the second screen unit and a second leg affixed to the first screen unit.

Figure 3:
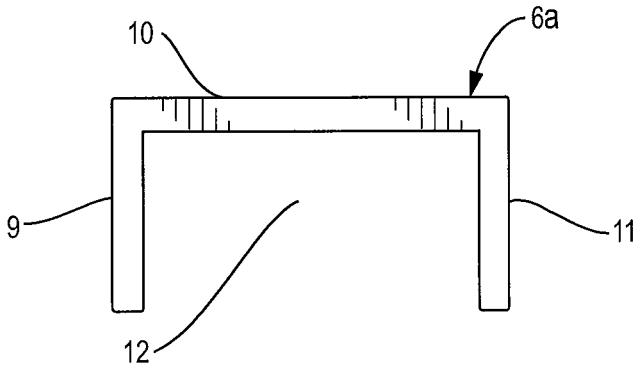
FIG. 3 shows an end view of a bracket used two hold the two screen units together.
Figure 4:
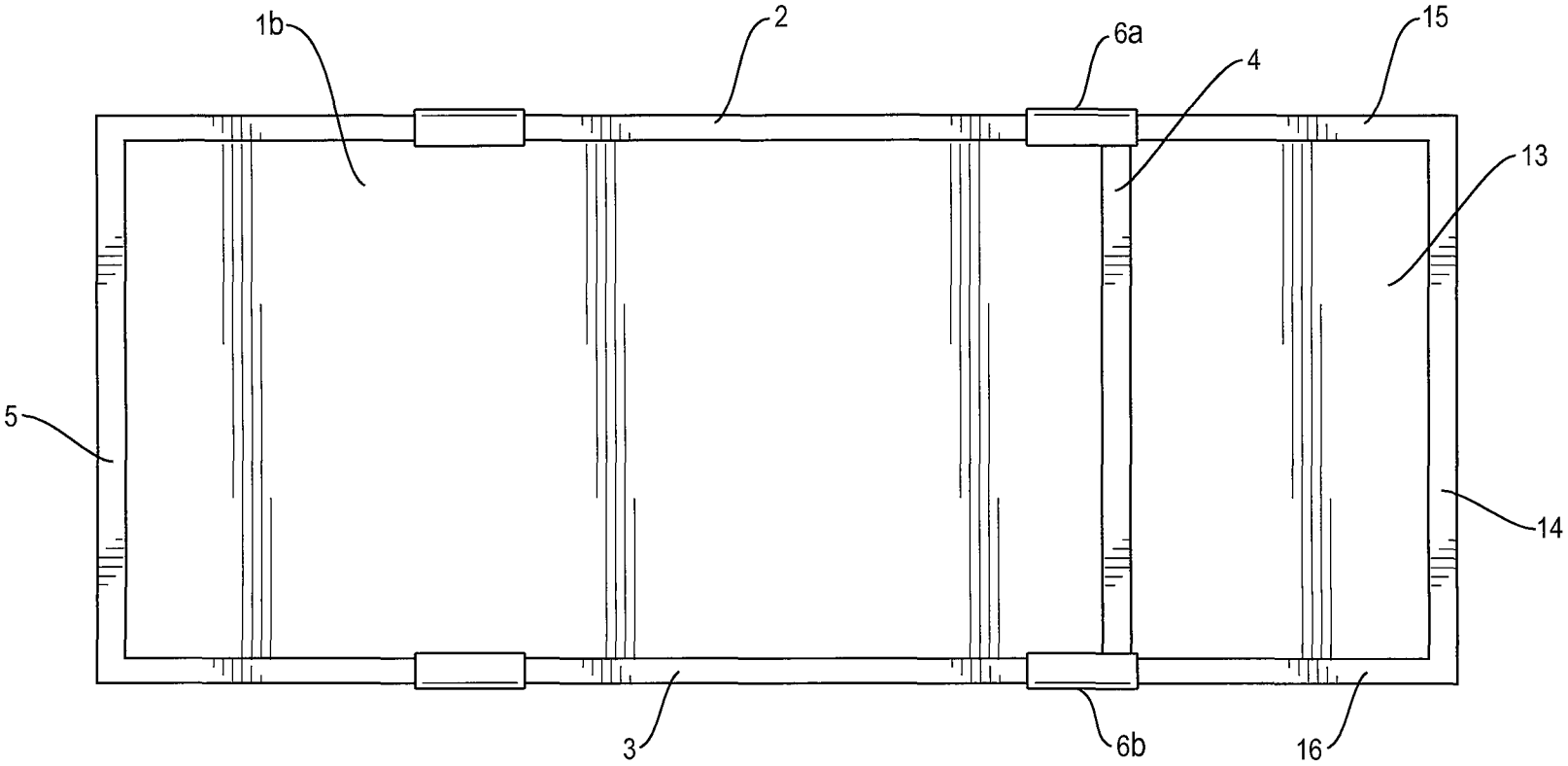
FIG. 4 shows a front view of a partially expanded two-plate window screen.

FIG. 3 shows an end view of one such bracket, prior to being affixed to the rectangular frame. FIG. 4 shows a front view of a partially expanded two-plate window screen, in which the entirety of the first plate 1 can be seen, along with a portion of the second plate 13. The first side member of the second screen unit 14 can be seen in this view, along with a portion of the top frame member 15 and a portion of the bottom frame member 16 of the second screen unit. The second side member of the second screen unit is not shown in this view because the plate of the first screen member 1 in this particular embodiment is opaque. The first screen unit and the second screen unit are mounted together in an overlapping manner with the back surface of the rectangular frame of the first screen unit facing the front surface of the rectangular frame of the second screen unit, such that the first and second screen units are mounted together by inserting the top frame member of the second screen unit in the cavity of one bracket of the first pair of brackets and the bottom frame member of the second screen unit in the cavity of the other bracket of the first pair of brackets and by inserting the top frame member of the first screen unit in the cavity of one bracket of the second pair of brackets and the bottom frame member of the first screen unit in the cavity of the other bracket of the second pair of brackets. The first pair of brackets and the second pair of brackets frictionally engage with the second screen unit and the first screen unit, respectively, thereby allowing the first and second screen units to be slidably moved relative to each other to adjust the width of the screen assembly.

The plates of the first and second screen members may be transparent, translucent or opaque. Opaque plates may be of a single or multiple colors, or may be decorated with art.

What is claimed is:

1. A screen assembly having an adjustable width for blocking a portion of an open window adjacent a side of a window mounted air conditioner unit, the adjustable screen assembly consisting of:

a first screen unit having a rectangular frame defining an opening in which is mounted a sheet of a solid material; the first frame having a top frame member, a bottom frame member opposite the top frame member, a first side frame member and a second side frame member each of which connect to opposite ends of both the top frame member and the bottom frame member;

a second screen unit having a rectangular frame defining an opening in which is mounted a sheet of a solid material; the second frame having a top frame member, a bottom frame member opposite the top frame member, a first side frame member and a second side frame member each of which are interconnected to opposite ends of both the top frame member and the bottom frame member;

a first pair of brackets affixed to the first screen unit, one bracket being fixed to the top frame member proximate where the first side member interconnects to the top frame member and the other bracket being fixed to the bottom frame member proximate where the first side member interconnects to the bottom frame member; each bracket of the first pair of brackets being U-shaped with a first leg affixed to a front surface of the rectangular frame of the first screen, a base extending across a width of the rectangular frame and beyond the width of the rectangular frame a distance substantially equal to the width of the frame and the second leg defining a cavity between the second leg and the back surface of the rectangular frame;

a second pair of brackets affixed to the second screen unit, one bracket being fixed to the top frame member proximate where the second side member interconnects to the top frame member and the other bracket being fixed to the bottom frame member proximate where the second side member interconnects to the bottom frame member; each bracket of the second pair of brackets being U-shaped with a first leg affixed to a back surface of the rectangular frame of the second screen unit, a base extending across a width of the rectangular frame and beyond the width of the rectangular frame a distance substantially equal to the width of the frame and the second leg defining a cavity between the second leg and the front surface of the rectangular frame;

wherein the first screen unit and the second screen unit are mounted together in an overlapping manner with the back surface of the rectangular frame of the first screen unit facing the front surface of the rectangular frame of the second screen unit; wherein the first and second screen units are mounted together by inserting the top frame member of the second screen unit in the cavity of one bracket of the first pair of brackets and the bottom frame member of the second screen unit in the cavity of the other bracket of the first pair of brackets and by inserting the top frame member of the first screen unit in the cavity of one bracket of the second pair of brackets and the bottom frame member of the first screen unit in the cavity of the other bracket of the second pair of brackets; and wherein the first pair of brackets and the second pair of brackets frictionally engage with the second screen unit and the first screen unit, respectively, thereby allowing the first and second screen units to be moved relative to each other to adjust the width of the screen assembly; and wherein the first pair of brackets are affixed to corners of the first screen unit defined by the intersections of the first side member with the top and bottom members and the second pair of brackets are affixed to corners of the second screen unit defined by the intersections of the second side member with the top and bottom members, and wherein when the first and second screen units are moved relative to each other in a first direction they fully overlap with the width of the screen assembly being equal to the width of either one of the first and second screen units and when they are moved in a second direction opposite the first direction the width of the screen assembly being equal to the combined widths of the first and second screen units.

2. The screen assembly of claim 1 wherein the sheets of solid material of the first and second screen units comprise one of plexi-glass, plastic, or glass.

3. The screen assembly of claim 1 wherein the rectangular frames of the first and second screen units are the same size.

* * * * *